US012215875B2

(12) United States Patent
Corneli et al.

(10) Patent No.: US 12,215,875 B2
(45) Date of Patent: Feb. 4, 2025

(54) SYSTEM FOR HEATING A LIQUID INCLUDING A HIGH-EFFICIENCY HEATER AND AN OPTIMIZER

(71) Applicant: H2OT S.r.l., Comunanza (IT)

(72) Inventors: Roberto Corneli, Montecosaro (IT); Marco Pignotti, Civitanova Marche (IT)

(73) Assignee: H2OT S.r.l., Comunanza (IT)

( * ) Notice: Subject to any disclaimer, the term of this patent is extended or adjusted under 35 U.S.C. 154(b) by 185 days.

(21) Appl. No.: 18/008,335

(22) PCT Filed: Jun. 7, 2021

(86) PCT No.: PCT/IB2021/054976
§ 371 (c)(1),
(2) Date: Dec. 5, 2022

(87) PCT Pub. No.: WO2021/250543
PCT Pub. Date: Dec. 16, 2021

(65) Prior Publication Data

US 2023/0204224 A1 Jun. 29, 2023

(30) Foreign Application Priority Data

Jun. 8, 2020 (IT) ..... 102020000013645

(51) Int. Cl.
*F24H 3/00* (2022.01)
*F22B 3/06* (2006.01)
(Continued)

(52) U.S. Cl.
CPC ..... *F24D 15/02* (2013.01); *F22B 3/06* (2013.01); *F24V 99/00* (2018.05); *F24D 2200/30* (2013.01)

(58) Field of Classification Search
CPC ..... F24D 15/02; F24D 2200/30; F24V 99/00
(Continued)

(56) References Cited

U.S. PATENT DOCUMENTS 4,372,254 A * 2/1983 Hildebrandt ..... F24V 40/10 122/26
2014/0290952 A1 10/2014 Lamb et al.

FOREIGN PATENT DOCUMENTS

DE 195 35 062 4/1997
FR 1.419.764 12/1965
(Continued)

OTHER PUBLICATIONS

International Search Report and Written Opinion of the ISA for PCT/IB2021/054976, mailed Sep. 28, 2021, 12 pages.
(Continued)

*Primary Examiner* — Davis D Hwu
(74) *Attorney, Agent, or Firm* — Nixon & Vanderhye P.C.

(57) ABSTRACT

A system (1) for heating liquids includes an hydrosonic pump (2) for the heating of the mentioned liquid; a primary circuit (3) in turn comprising, at least: a storage (30) of the above-mentioned liquid or a heat exchanger (45); a plurality of pipes (31, 32), in order to get a mutual connection with the mentioned storage (30) or heat exchanger (45) with the said hydrosonic pump (20), at least one solenoid valve (34), to open and/or close the liquid circulation within the mentioned primary circuit (3), at least one sectioning valve (8), in order to adjust the flow rate of the mentioned liquid output from the said hydrosonic pump (2). The system (1) further comprises an optimizer (5) connected to and placed downstream of said hydrosonic pump (2), the optimizer cooperating with at least said primary circuit (3) to which it gives and transfers the thermal energy produced by said hydrosonic pump (2), said optimizer (5) comprising a low-
(Continued)

capacity storage tank (52), operating at high pressure and thermally insulated.

10 Claims, 5 Drawing Sheets

(51) Int. Cl.
*F24D 15/02* (2006.01)
*F24V 99/00* (2018.01)

(58) Field of Classification Search
USPC ..... 165/47
See application file for complete search history.

(56) References Cited

FOREIGN PATENT DOCUMENTS

| | | | | |
|---|---|---|---|---|
| JP | 2014129978 | A | * | 7/2014 |
| KR | 10-2011-0032112 | | | 3/2011 |
| KR | 10-2013-0015825 | | | 2/2013 |
| RU | 2454609 | C2 | | 6/2012 |

OTHER PUBLICATIONS

Search Report dated Sep. 12, 2024, issued in Russian Federation Application No. 2022130547, 2 pages.
Office Action dated Sep. 13, 2024, issued in Russian Federation Application No. 2022130547, 4 pages.

* cited by examiner

SYSTEM FOR HEATING A LIQUID INCLUDING A HIGH-EFFICIENCY HEATER AND AN OPTIMIZER

This application is the U.S. national phase of International Application No. PCT/IB2021/054976 filed Jun. 7, 2021, which designated the U.S. and claims priority to IT Patent Application No. 102020000013645 filed Jun. 8, 2020, the entire contents of each of which are hereby incorporated by reference.

The present invention is an innovative system for liquid heating, especially for the production of domestic hot water and/or for heating, for household and/or industrial use.

More precisely, the object of the present invention is an innovative system for liquid heating based on the so-called "cavitation principle" with a high efficiency and energy performance.

Therefore, the invention is included in the field of devices and systems for heating fluids, and in particular liquids.

More precisely, the present invention is applicable within the field of devices using rotating elements to generate heat in the liquid passing through them, such as the so-called "hydrosonic pumps", also known as "hydrothermal turbine systems", schematically shown in the example in FIG. 1.

It is well known that "hydrosonic pumps" 2 for liquid heating were conceived and industrially developed in the late 1980s and early 1990s.

For this purpose, the aforementioned pumps 2, which can be crossed by a liquid to be heated, and generally water, include a perforated cylindrical "rotor" 23, i.e. equipped with a plurality of cavities 231, assembled with a rotation shaft 24, and a "stator" 22 within the mentioned rotor 23, the stator is able to rotate at high speed driven by an electric motor 21 (e.g. three-phase and powered indifferently by electric, solar, wind, pneumatic energy, etc.), it is connected and works together in a known procedure with said shaft 24.

The stator 22 is also a cylindrical body which includes a crimped inner surface and a pair of metal discs/covers 25 and 26 for the airtightly closing of its ends (from now on "end plates" or "closing flanges" 25, 26).

The rotor 23 and the stator 22, which constitute the so-called "turbine" 20 of the hydrosonic pump 2, are installed coaxially. They have a specifically dimension and diameter, so the gap or interspace between them can be filled and crossed by the liquid to be heated (more precisely, the gap between the internal crimped surface of the stator and the external surface of the rotor)

A specific pipe system connects the abovementioned hydrosonic pump 2 to a primary circuit 3, and in particular to at least one of its liquid storage 30, for the production of domestic hot water and/or to a secondary circuit 4 which includes, for example, a heat exchange unit to heat up a room (see FIG. 2).

It is also useful, because the mentioned liquid storage 30 may be implemented to the level of the heat exchange unit, for example a plate unit or a coil unit.

Since the characteristics and the operating process of said hydrosonic pumps 2 are well known to the technicians of the sector, we will not go into a detailed description, instead we will refer for further details to document U.S. Pat. No. 5,188,090 A.

A prior art document disclosing a system for heating water for domestic purposes based on a cavitation turbine is KR 2011 0032112 A.

However, it is herein useful to point out that these machines heat the liquid mainly through the cavitational effect. It is well known that, this effect is based on the creation of areas or bubbles within the liquid that, due to variation of pressure blow up; during this process they release energy, and precisely heat, moreover the energy is absorbed by the liquid itself.

In other words, the heating of the cited hydrosonic pumps is achieved thanks to the very high turbulence of the liquid caused by the particular geometric and structural conformation of the rotor 23, and by its cooperation with the stator 22.

It has been experimentally found that, due to this turbulence, these hydrosonic pumps 2 are able to achieve a much higher efficiency than the traditional thermal generators, the ones generally used for the production of domestic hot water and/or for space heating (e.g., common household boilers).

However, performance obtained so far has not proved to be fully satisfactory, it is also due to the significant complexity of architecture of a hydrosonic pump 2 and due to the issues linked to it; this deficiency has negatively influenced its industrialisation and commercialisation.

For example, it has been highlighted that such a hydrosonic pump 2 for the production of domestic hot water and/or for space heating is able to reach its maximum efficiency only when the temperature of the input liquid inside the mentioned pump 2 is not "too far" (with respect to the quantity/flow rate of the circulating liquid) from the one of the same liquid output from the cited pump 2; indeed, under such conditions, the maximisation of the cavitational effect is ensured.

For this purpose, as extensively described with the previous Italian patent application No. 10201800006358, to which reference is made for further details, a specific mode of activation and management of the hydrosonic pump 2 is considered and implemented, the main purpose is to optimise and maximize the efficiency and performance. This mode, during the initial process of activation of the hydrosonic pump 2 (i.e. before reaching full operation), has a series of heating phases of the liquid, each phase is bound to another; in particular, during the first phase, the hydrosonic pump 2 is activated for a first rapid heating of the liquid loaded in it, moreover, during this phase, the circulation towards the primary circuit 3 is locked, as well as a subsequent phase where is passed between the hydrosonic pump 2 and the storage 30 of the primary circuit 3, once this has reached the desired temperature (see FIG. 2).

These phases are repeated until the gradient between the inlet and outlet temperature of the in/out liquid of the abovementioned hydrosonic pump 2 matches or deflect from an optimal value that ensures the best and maximum energy performance. (As an alternative to this procedure of activation and management of the hydrosonic pump with repeated interruptions of the liquid flow, it would be possible to heat the liquid circulating in the hydrosonic pump 2 and the storage tank 30 of the primary circuit 3, but only as a whole, and much more slowly, with no benefit and less efficiency).

From what has just been said, it is clear the complexity of managing the hydrosonic pump 2 of the prior art, especially during the initial and temporary phases of the procedure, and also the difficulties related with the connection and cooperation with the primary and secondary circuits.

The achievement of optimal operating conditions and their retention take a long time to implement, it also causes a considerable delay in order to achieve full availability and operability of the liquid heating system for sanitary use and/or for indoor heating.

The results may also reflect an increase of the operating costs of the system itself.

The aim of the present invention is to delete the disadvantages of the known technique listed above, through an innovative system for liquid heating, and preferably for the production of domestic hot water and/or for space heating, and capable of achieving and ensuring maximum efficiency and energy performance quickly and in a simple and reliable manner.

These and other goals are achieved in accordance with the invention, its features are listed in the attached independent claim 1.

Further features of the present invention will be better evidenced in the following description of a preferred embodiment, and in accordance with the patent claims; it will be illustrated, for explanation only, in the attached drawing figures, wherein:

Figure 1:
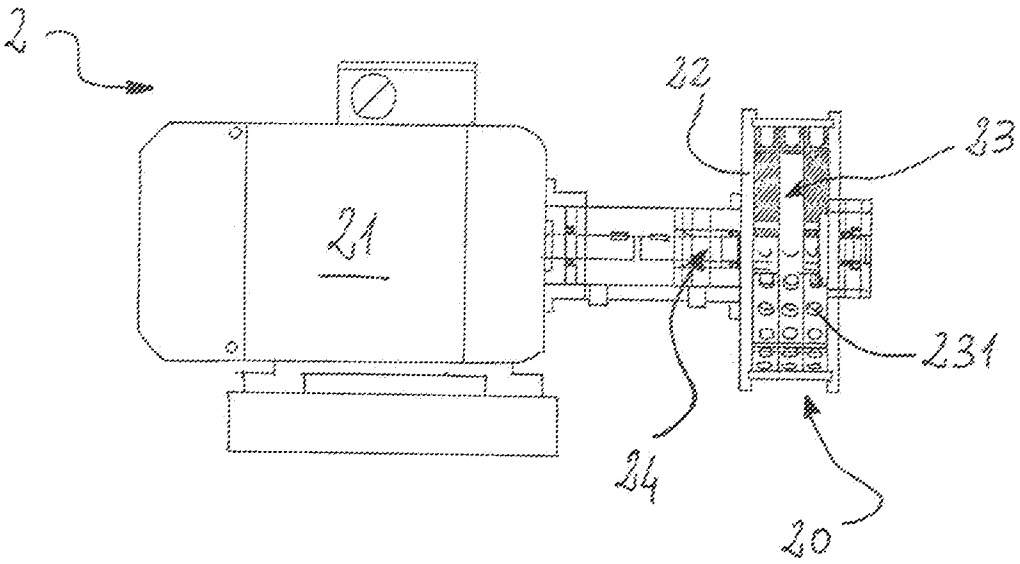
FIG. 1 illustrates, in section and schematically, a hydrosonic pump according to the state of the art.

In order to describe the elements of the device according to the invention, it is useful to make reference to the attached figures. It should be noted that any dimensional and spatial word (such as "lower", "upper", "right", "left" and the like) refers, unless it is differently specified, to the correct setting of the invention, as indicated in the drawings, and it does not necessarily correspond with the setting of the invention during working conditions.

In order to highlight certain features rather than others, what is shown on the attached drawings is not necessarily drawn to scale.

Furthermore, the elements illustrated on the drawings cannot be considered all essential to the invention; the ones which are essential are explicitly indicated. Moreover, like references will correspond to components of the system of the invention as those already described with reference to the state of the art.

Figure 3:
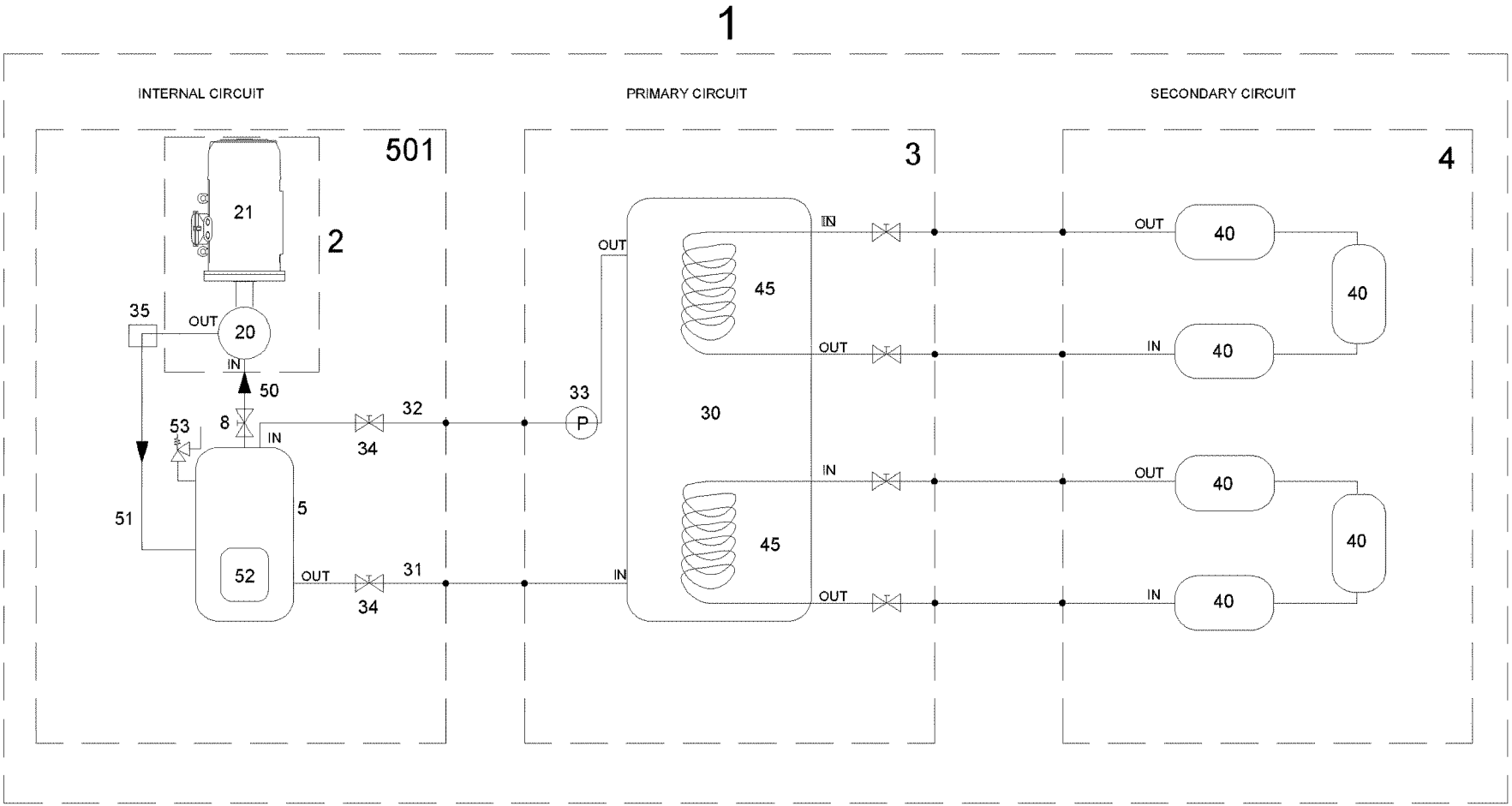
FIG. 3 illustrates schematically system 1 for heating a liquid according to a possible variant of the invention.

As clearly shown in FIG. 3, 1 represents the system for liquid heating, and preferably for producing domestic hot water and/or for space heating.

According to the invention, of such a system FIG. 1 particularly shows:

- a hydrosonic pump 2 as the same of the prior art described above (for further details, please refer again also to the previous application n° 10201800006358, already cited) which has the capacity to exploit the phenomenon of cavitation and carry out the heating of a liquid, the mentioned hydrosonic pump 2 has (see also FIG. 1) at least one "cavitational" turbine 20 and an electric motor 21, which is capable to power and run the above-mentioned turbine 20;
  - an "optimizer" 5, which is linked to and located downstream of the hydrosonic pump 2, the technical-functional characteristics and relative advantages will be shortly described in detail; the optimizer 5 is likely to cooperate at least with a primary circuit 3 in order to move the thermal energy produced by the hydrosonic pump 2;
  - the abovementioned "primary" circuit 3, which has at least one storage tank 30 for storing the liquid heated by said hydrosonic pump 2 and circulated through said optimizer 5;
  - the abovementioned "primary" circuit 3, which has a heat exchange unit 45 as an alternative or not to a storage tank 30, it exchanges the heat from the hot liquid from the said hydrosonic pump 2 and circulated through said optimizer 5.

The system 1 of the present invention may further include a secondary circuit 4 (see FIG. 3) to dissipate heat generated in said hydrosonic pump 2 and transmitted to the liquid flowing through it, and to the said secondary circuit 4 which it works with and/or connected to the primary circuit 3.

Henceforth, both the hydrosonic pump 2 and the optimizer 5 may also be referred to as "high efficiency cavitation boiler".

The above-mentioned cavitation boiler may further include an expansion vase (which is not shown in the attached figures) which, as is well known, has the function of containing the volume increase of the liquid heating and the resulting pressure variations, it also avoids pressure surges and water hammer, otherwise they would be absorbed, by the system, and cause a potential damage.

Figure 4:
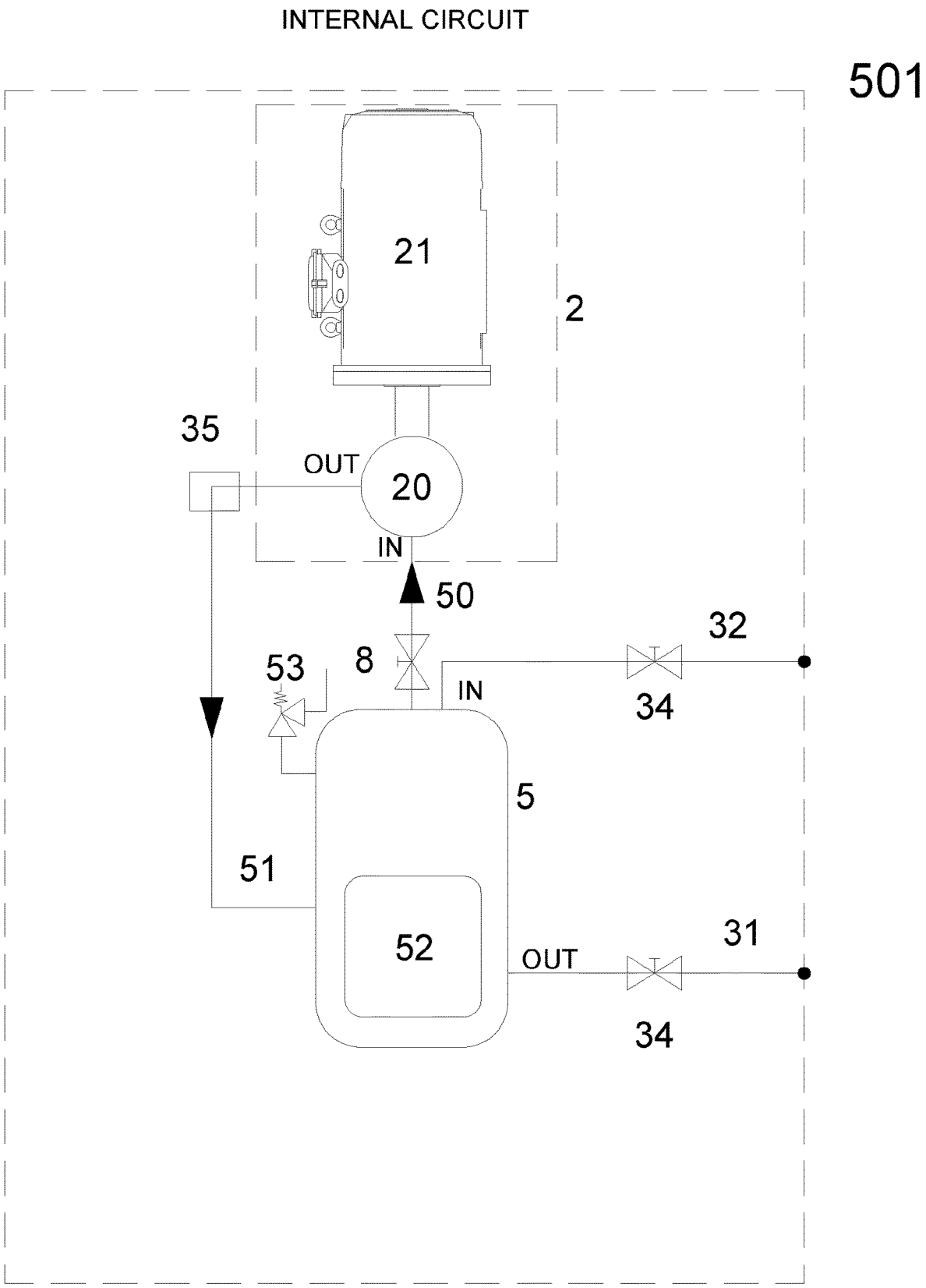
FIG. 4 illustrates the internal circuit 501.
Figure 5:
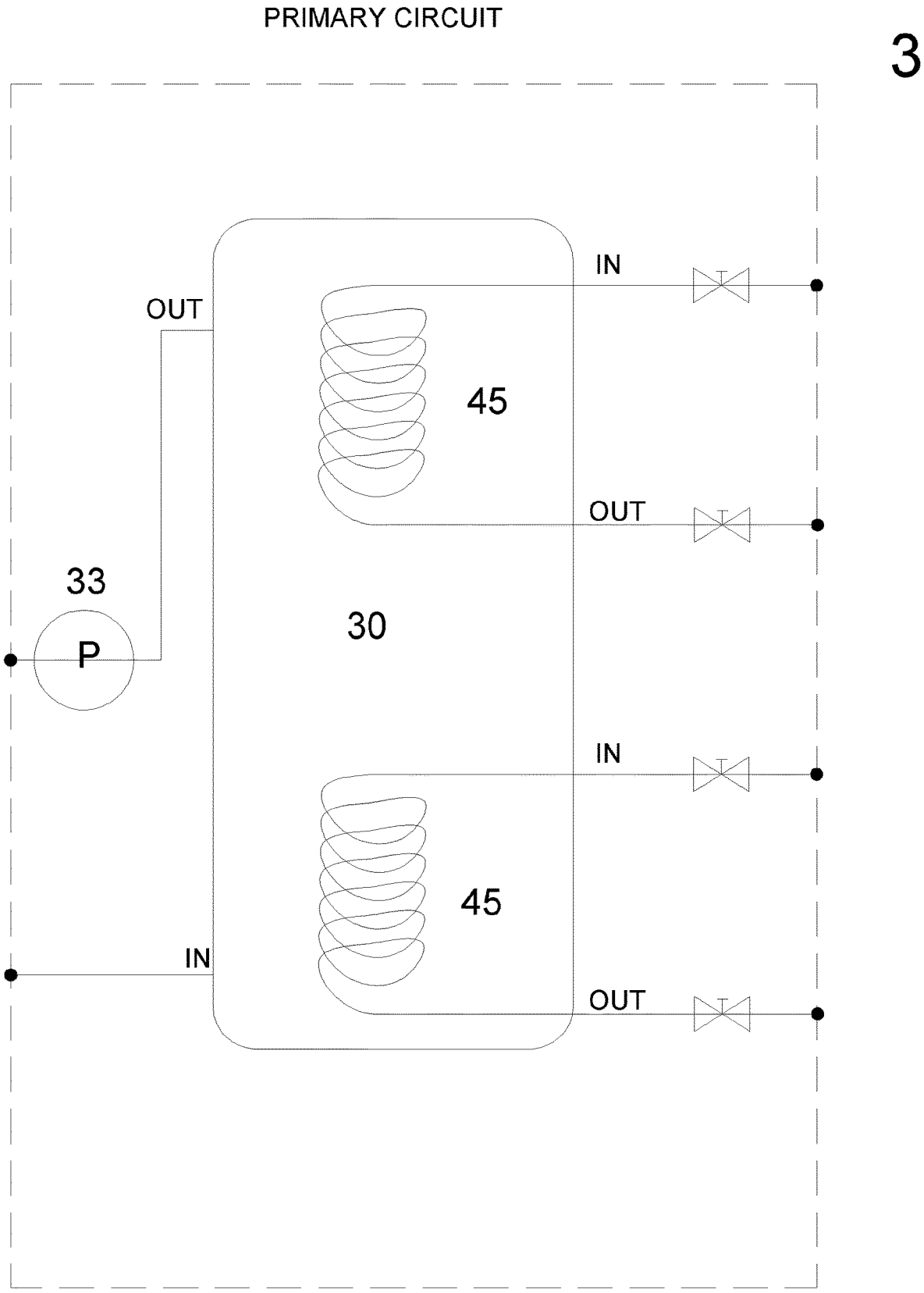
FIG. 5 illustrates the primary circuit 3.

The reciprocal connection between said pump 2 and said optimizer 5, included of the high-efficiency cavitation boiler, is ensured by respective flow 51 and return 50 pipes as shown in FIG. 3, these flow 51 and return 50 pipes, both named "internal circuit" 501, for more details see attached FIG. 4.

It is also useful to specify that, for reasons which will be further clarified hereinafter, there are also flow and return pipes 31, 32 between said optimizer 5 and said storage tank 30 of the primary circuit 3; in particular, a flow pipe 31 from the optimizer 5 to the storage tank 30 and a return pipe 32 that, conversely, carries the liquid from the storage tank 30 back to the optimizer 5; otherwise a flow pipe 31 from the optimizer 5 to the heat exchanger 45 and a return pipe 32 that, conversely, carries the liquid from the heat exchanger 45 back to the optimizer 5.

The circulation of the liquid between the optimizer 5 and the primary circuit 3 can be ensured by at least one first pump 33 and its flow rate regulated by at least one suitable solenoid valve 34.

More precisely, the abovementioned solenoid valve 34 is able to interrupt and/or re-establish, in accordance with the detected temperature, the circulation of the liquid from the optimizer 5 towards the abovementioned primary circuit 3, and it is able to set its circulation temperature.

For this purpose, the solenoid valve 34 is linked to sensors and/or temperature probes 35 which are placed in correspondence with the hydrosonic pump 2 within the internal circuit 501 and along the outflow pipe 51 from the optimizer 5.

As clearly shown in FIG. 4, at least one solenoid valve 34 is placed along the flow line 31 of the primary circuit 3.

Optionally, a second circulation pump may also be provided within the cavitation boiler, it can ease liquid's flow to be heated between its cavitational turbine 20 and the optimizer 5.

As discussed in the following, the circulation within the cavitation boiler may take place directly through natural flow, without the aid of mechanical pushing devices.

Figure 2:
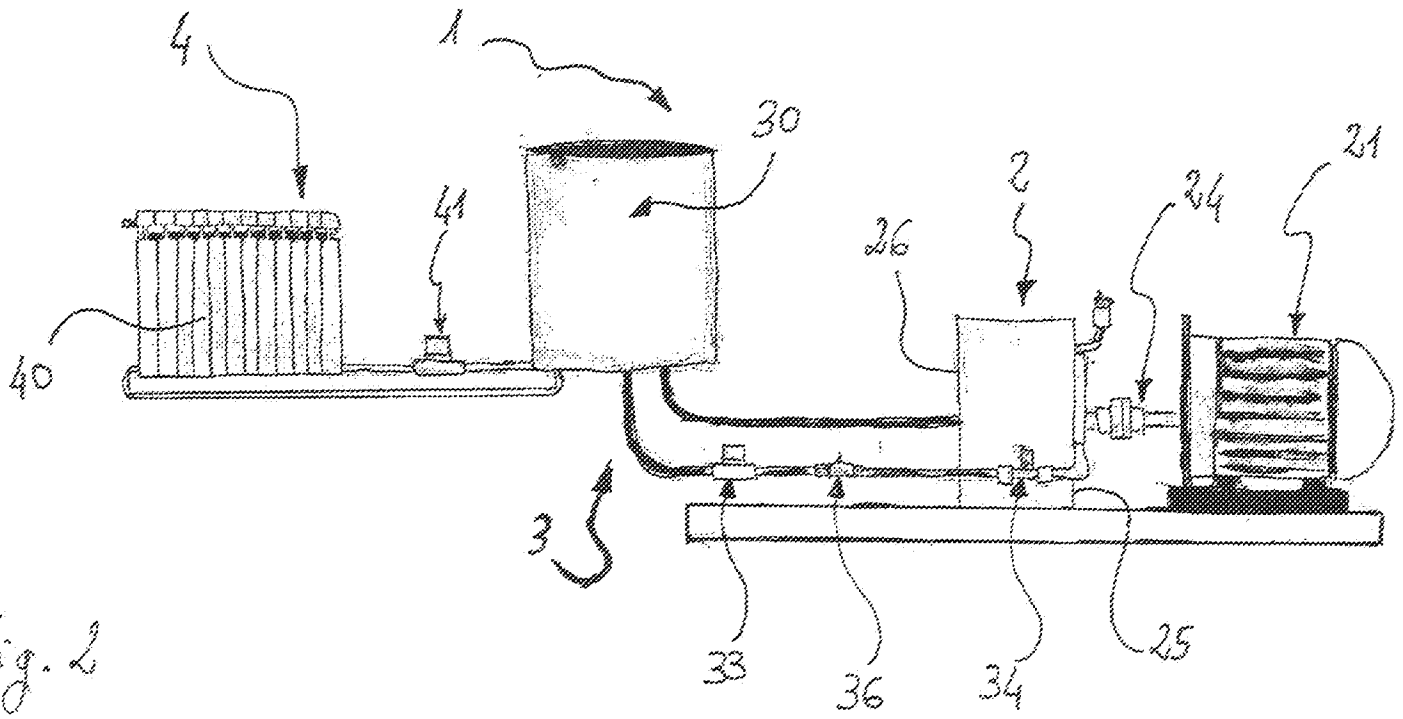
FIG. 2 illustrates a schematically system for heating a liquid according to the state of the art.

In both cases a flow disconnector 8, see FIG. 3, and FIG. 4, (also named disconnecting valve, analogous to the one of the prior art indicated with reference 36 in FIG. 2) allows regulation of flow and in particular the flow rates.

The secondary circuit 4 has the function of dissipating heat generated by the high efficiency cavitation boiler, it consists of:

- at least one heat exchanger 40 for the dissipation; the heat exchanger 40 has at least one radiator for space heating 40; and/or one or more heat exchangers, e.g., coil heat exchanger, inserted within the storage 30 of the primary circuit 3; and/or any device for the supplying the liquid directly.

At least one circulation pump which ensures the flow of the abovementioned liquid within the secondary circuit 4.

It has been already partially explained that the cavitation boiler of the invention achieves its maximum energy performance and efficiency when the temperature of the liquid, which goes into the turbine 20 of the hydrosonic pump 2 to be heated, has a temperature "not far" (with reference to the amount of the circulating flow) from the one of the same liquid when it is heated and exits the hydrosonic pump 2. Under such conditions, the hydrosonic pump 2 does not suffer any thermal "shock", and thus avoids any possible slowdowns or unfavourable conditions for liquid heating.

In other words, it has been observed that the cavitation boiler of the invention reaches maximum operating efficiency when the differential (or gradient) between the inlet and outlet temperatures of the liquid in/from the turbine 20 of the hydrosonic pump 2 is kept constant and equal to a value defined from now on as ΔTideal.

For this purpose, i.e. to manage the flow of the circulating liquid and keep the abovementioned ΔTideal, as an alternative to the storage 30 of the primary circuit 3 of the state of the art, it is envisaged to use a specific and dedicated inertial accumulation of the liquid treated in the hydrosonic pump 2 having a reduced volume and able to avoid the leakage of the heat already stored therein and to withstand fairly high pressures (in fact, during working conditions, the liquid can be at high temperatures a thus be in a vapour state if not circulated at a suitable pressure).

According to the invention, the abovementioned inertial storage is therefore a "small" storage, it corresponds with the optimizer 5 mentioned above.

Indeed, the optimizer 5 is arranged to allow the cavitation boiler (and in particular its cavitation turbine 20) to exchange heat with the primary circuit 3 and/or with the secondary circuit 4 without substantial variations of the abovementioned gradient ΔTideal (which is kept constant).

As previously highlighted, the ΔTideal is the gradient that ensures the maximum efficiency of the hydrosonic pump 2, it can be advantageously chosen as a fixed and optimal threshold, it can be set through probes or thermostats.

The experiments have shown that the abovementioned ΔTideal is a function of at least the delivery temperature of the hydrosonic pump 2 (or equivalently of the outlet temperature of its turbine 20), that is, it can increase as said temperature increases.

On the other hand, indicating by ΔToptimizer the temperature gap between the inlet and outlet liquid of the optimizer 5, it is desired that this gradient never falls below the aforementioned threshold ΔTideal, so the performance of the cavitation boiler can be maximized.

For this purpose, the aforesaid solenoid valve 34 (or technically equivalent means) "manages" the flow of the liquid, between the optimizer 5 and the primary circuit 3, as follows:

interrupting it when the ΔToptimizer falls below said ΔTideal, and consequently allowing a further rapid heating of the liquid circulating between the water pump 2 and the optimizer 5 until at least the optimal ΔToptimizer is restored.

In other words, the abovementioned optimizer 5 works in order to keep the ΔToptimizer, on operating conditions, equal to ΔTideal.

Such operating mode of the system 1 of the invention will be discussed shortly in a more specific and detailed manner.

It will suffice herein, to repeat how the abovementioned optimizer 5 substantially behaves as a sort of "thermal flywheel", thus, it allows the liquid heated by the hydrosonic pump 2 to transfer part of its heat to the primary circuit 3 and/or secondary circuit 4 without any substantial change or variations of the ΔToptimizer.

In other words, the abovementioned optimizer 5 is a device able to work between a first and a second operating temperature, wherein:

the first temperature is the one at which the solenoid valve 34 interrupts the circulation of the liquid towards the primary circuit 3 and/or the secondary circuit 4, in order to allow the flow to circulate exclusively between the optimizer 5 and the hydrosonic pump 2 so as to restore the maximum efficiencies of the cavitation boiler, and the second temperature is the one that allows the reopening and the connection of the optimizer 5 towards said primary circuit 3 and/or secondary circuit 4 once said maximum efficiencies are guaranteed.

Generally, the first operating temperature is lower than the second operating temperature, indeed their gap defines the abovementioned ΔToptimizer.

According to the invention, the aforementioned optimizer 5 has a storage tank 52 with a lowered volume, but it is resistant to high pressures in order to allow a swift or a sudden heating.

More precisely, the aforementioned optimizer 5 has a capacity intermediate the traditional storages for liquids (generally the tanks have different volumes and they start from 20-30 litres, moreover they do not operate at high operating pressure) and a hydraulic compensator (it is well known to the skilled in the art and with a maximum volume between 2-3 litres, but it withstands at high operating pressure).

The optimizer 5 is thermally insulated in order to reduce the unavoidable heat losses of the liquid processed and contained within it; in other words, the insulation is able to reduce heat losses when the hydrosonic pump 2 stalls, it preserves high temperatures inside the tank 52 even for many consecutive hours.

In this respect, just by way of example and with no limiting intents, the tank 52 of the abovementioned optimizer 5 has a volume between 7 and 15 litres and it is able to withstand pressures of even more than 20 bar.

As clearly shown in the diagram of FIG. 4, the tank 52, ideally, has two inlets within the aforementioned pipes 50, 32 for the supply and return flow, and specifically from the hydrosonic pump 2 and from the primary circuit 3, and two outlets within the pipes 31, 51 for the supply and return flow, and specifically from the primary circuit 3 and from the same hydrosonic pump 2.

Moreover, reference 53 in FIG. 3 identifies a typical and automatic air escape valve (also known as a wild card valve) from the supply 52 of the optimizer 5.

The hydrosonic pump 2, its motor 21 and the optimizer 5 can be settled and placed side by side or stacked vertically on several levels on a frame (also known as a chassis or the housing of the cavity boiler).

The abovementioned chassis may also fit a control panel and a screen for the setting, as well as managing and displaying the other working and functional parameters of the system 1 of the invention and the related boiler.

Once finished to describe the liquid heating system 1 in all its technical and constructive aspects, we may now move on and describe specifically the optimisation procedure of the relatively high-efficiency cavitation boiler, this efficiency can be achieved thanks to the presence of at least the aforementioned optimizer 5.

Without any limiting purpose, it has been experimentally observed that the optimisation of the performance of the cavitation boiler can be achieved when the following working and/or temporary conditions are fulfilled:

- the cavitation turbine 20 of the hydrosonic pump 2 handles a stream of liquid/circulating flow rate between 200 and 300 litres/h, it can be set and kept constant by the aforementioned sectioning valve and it is susceptible to "pass" and flow without interruption through the optimizer 5, this until is reached a returning temperature within the turbine preferably between 100° C./110° C.
- once the returning temperature has been reached, the solenoid valve 34, which is connected to at least one thermostat-probe 35, starts the circulation of the liquid between the optimizer 5 and the primary circuit 3, and in particular towards the relevant storage tank 30 where the heated liquid starts to progressively replace the colder liquid which is already inside it and, in fact, it goes back through the aforementioned return pipes 31 to the optimizer 5.

This circulation between the accumulation 30 of the primary circuit 3 and the optimizer 5 inevitably leads to a lower temperature inside the optimizer 5 itself, up to measures far below the aforementioned turbine return temperature of 100° C.

It has been observed experimentally that this circulation leads to a drop of the return temperature up to 90-97° C.; therefore, under these conditions the thermostat sensor closes the solenoid valve 34, the one that was previously opened.

Once the ideally abovementioned return temperature of 100° is reached again, and thanks to the continuous flow of heated liquid between the optimizer 5 and the hydrosonic pump 2, the solenoid valve 34 starts again the circulation towards the primary circuit 3 and the circulation, so the heat exchange process is repeated.

The secondary circuit 4 for heat dispersion (as already discussed, the aforesaid radiators and/or exchangers inside the storage 30, etc.), can exchange heat with the storage tank 30, once the right temperature for the room "served" thereby has been reached, the secondary circuit will control the switching off or the stand-by of the high-efficiency cavitation boiler, through a special and specific thermostat, until the gradient ΔToptimizer and the ΔTideal have substantially the same value.

Just in case the secondary circuit needs more heat, the scheme 1 of the invention is able to supply it immediately, due to the fact that the ΔToptimizer has remained steady and equal to ΔTideal.

Therefore, the circulation between the optimizer 5 and the hydrosonic pump 2 is never stopped and the hydrosonic pump does not suffer from any thermal shock; consequently, the liquid heating, which can be used for hygienic purposes and/or for room heating, has a gradient ΔTideal and a temperature at the inlet and the outlet from/to the abovementioned hydrosonic pump 2 which is substantially steady, so the ideally temperature is:

- equal to about 30° C.; as already examined, the temperature is referred to an outlet/discharge temperature of about 130° C. and a return temperature in turbine 20 of approximately 100° C.;
- equal to about 35° C., the temperature is referred to an outlet/delivery temperature of about 145° C. and a return temperature in turbine 20, of about 110° C.

During the time of practical implementation of the invention, various modifications and further changes are considered, because they all fall back into the same inventive concept; indeed, all the several components and details described above may also be replaced by technically equivalent elements.

In conclusion, the system for liquid heating, especially for the production of domestic hot water and/or for heating, and the relative method for optimising its energy performance and efficiency, have achieved its targets; in particular, it is possible to ensure high efficiency and performance by using mechanical components which have the following characteristics: they are simple to construct, economical and highly reliable; all this in a quick, easy and reliable manner.

Moreover, the system 1 of the invention is suitable for many other purposes; in fact, as well as its application for the production of domestic hot water for civil or industrial use and for space heating, it can be used, as a non exhaustive examples, for climatization, for the supply of hot water in household appliances (e.g., washing machines and dishwashers), for the supply of industrial machines (e.g., hot printing machines, and other), and heat pumps, etc.

The invention claimed is:

1. A system for heating a liquid comprising at least
a hydrosonic pump for heating said liquid,
a primary circuit comprising at least:
- a storage of said liquid, or a heat exchange unit
- a plurality of pipes for mutual connection of said storage or said heat exchange unit with said hydrosonic pump
- at least one solenoid valve to open and/or close the liquid circulation within the said primary circuit, wherein it further comprises an optimizer connected to and placed downstream of said hydrosonic pump and cooperating with at least said primary circuit to give and transfer thereto the thermal energy produced by said hydrosonic pump, said optimizer comprising a storage tank:
- of reduced volume, intermediate the one of a conventional liquid storage and a hydraulic compensator;
- capable of withstanding and working at high pressure;
- thermally insulated, said optimizer comprising at least one sectioning valve in order to control the flow rate of said liquid circulating in said hydrosonic pump, placed within an internal circuit preferably along a return pipe of said optimizer, operating and ensuring a temperature gradient ΔToptimizer between an inlet and outlet liquid equal to the gradient ΔTideal between an inlet and outlet temperature of said hydrosonic pump to facilitate maximum efficiency and energy performance.

2. The system for heating a liquid according to claim 1, wherein the fact that at least one solenoid valve is configured to stop and/or re-establish the flow of the liquid from said optimizer towards said primary circuit, said solenoid valve being arranged to be connected to sensors and/or temperature probes placed in the internal circuit and preferably along the return pipe or the delivery pipe of the abovementioned optimizer.

3. The system for heating a liquid according to claim 2, wherein the fact that said at least one solenoid valve is located along the outflow line or the return line of said plurality of pipes of said primary circuit.

4. The system for heating a liquid according to claim 1, wherein further comprising an additional secondary circuit for dissipating heat generated in said hydrosonic pump and transmitted to said liquid, said secondary circuit cooperating and/or being connected to said primary circuit.

5. The system for heating a liquid according to claim 4, wherein the fact that said secondary circuit comprises at least:

a heat exchange unit which includes at least one radiator, and/or one or more coil heat exchangers placed within said storage of said primary circuit, and/or direct supply devices.

6. The system for heating a liquid according to claim 1, further including an additional expansion vase.

7. The system for heating a liquid based according to claim 1, including one or more circulation pumps within said primary and secondary circuits.

8. The system for heating a liquid according to claim 1, wherein the fact that the reservoir of the abovementioned optimizer has a capacity in the range of 7 and 15 litres, and it is capable of withstanding pressures of even more than 20 bar.

9. The system for heating a liquid according to claim 1, wherein the fact that the flow rate of the circulating liquid is constantly kept by the sectioning valve between 200 and 300 litres/h, proceeds with a ΔTideal gradient equal to approximately 30° C. with reference to an outlet/delivery temperature of approximately 130° C. and a return temperature within the turbine of about 100° C.; otherwise, the abovementioned flow rate proceeds with a ΔTideal gradient equal to approximately 35° C. with reference to an outlet/delivery temperature of approximately 145° C. and a return temperature within the turbine of about 110° C.

10. The system for heating a liquid according to claim 1, wherein the fact that at least said hydrosonic pump, its motor and said optimizer are arranged and mounted stacked vertically on plural levels and on a frame or chassis.

* * * * *